United States Patent [19]

Takahashi

[11] 4,309,129

[45] Jan. 5, 1982

[54] METHOD AND APPARATUS FOR IMPROVING THE STRENGTH OF SOFT VISCOUS GROUND

[76] Inventor: Yuichiro Takahashi, 1-2-6, Bandai, Niigata City, Niigata Pref. 960, Japan

[21] Appl. No.: 903,704

[22] Filed: May 8, 1978

[30] Foreign Application Priority Data

May 23, 1977 [JP] Japan ..... 52-59517

[51] Int. Cl.[3] ..... E02D 3/12

[52] U.S. Cl. ..... 405/269; 73/84; 405/267

[58] Field of Search ..... 405/233, 236, 242, 253, 405/258, 263, 266, 269, 267; 73/81, 84, 85

[56] References Cited

U.S. PATENT DOCUMENTS

| | | | |
|---|---|---|---|
| 2,357,769 | 9/1944 | Rushmer | 405/269 |
| 2,440,921 | 5/1948 | Stephens | 405/269 |
| 3,148,538 | 9/1964 | Heerema | 73/84 |
| 3,243,962 | 4/1966 | Ratliff | 405/269 X |
| 3,397,542 | 8/1968 | Moulden | 405/266 |
| 3,623,330 | 11/1971 | Nakade et al. | 405/266 X |

*Primary Examiner*—David H. Corbin

*Attorney, Agent, or Firm*—Thomas R. Morrison

[57] ABSTRACT

A method and an apparatus for improving the strength of a soft viscous ground are disclosed. For improving the strength of an area of some extent, hardenable liquid consisting essentially of cement milk is injected into each one of a plurality of preselected points for promoting dehydration and compaction of the ground. The liquid is hardened in a short time for forming a rigid tree-like structure. A measure or index for the local ground strength is obtained at first by using a measuring/injection device, and the injection pressure is set to be slightly larger than the measure or index so obtained. The liquid may then be permeated into the soft viscous ground at substantially the same injection pressure until the ground is consolidated satisfactorily.

12 Claims, 19 Drawing Figures

METHOD AND APPARATUS FOR IMPROVING THE STRENGTH OF SOFT VISCOUS GROUND

BACKGROUND OF THE INVENTION

This invention relates to the consolidation of the soft or viscous ground consisting mainly e.g. of clay or peat formations.

It is so far known to use a so-called replacement method or a dehydrating and compacting method for consolidation of the soft or viscous ground. With the former method, the soft or viscous ground is removed to a certain depth by mechanical excavation or explosion and replaced by sand or soil of acceptable properties. This method involves a lot of labor and can only be applied to the ground formation of shallow depth in the order of from 2 to 3 meters from the surface. According to the latter method, soil or sand is placed on the soft ground to a certain thickness, the soft ground being thus placed under the load of the soil or sand and subjected to gradual dehydration and compaction. This method has naturally a drawback that a longer working time is required until the soft ground is dehydrated and compacted satisfactorily. In order to shorten the working time to some extent, sand or paper piles are driven into the ground prior to the placement of the soil or sand load. These sand or paper piles provide the passage through which the pore water contained in the ground can be discharged to the ground surface. These known methods are not satisfactory if the soft ground must be consolidated within a short contract period or in case of consolidation of river beds. Consequently, there has been a strong demand for a construction method for consolidating the soft or viscous ground in a short time and without resorting to the laborious process of placing a sand or soil load on the ground.

The present inventor has found that the soft or viscous ground can be consolidated through compulsory injection into the ground of a hardenable fluid material, such as cement mortor or milk, by resorting to mechanical pumping means installed on the ground surface.

The hardenable fluid material is allowed to harden in the underground zone thus forming a rigid plate-or column-like structure which serves as a skeleton for the ground, as disclosed in the Japanese Patent Application No. 14393/1970 (now published as Japanese Patent Publication No. 23377/1973).

The soft ground formation, such as clay stratum, has a variable pore volume depending on its looseness, such pore volume being generally saturated with water known as pore water. Such stratum can be consolidated by discharging the pore water through mechanical compaction by the injected material and reducing the pore volume.

According to the inventor's researches which were made public by the above Japanese Publication, the injected cement motar or the like fluid material is not introduced into the existing interstices of the clay particles, but is forced into the ground while compulsorily forming vertical or nearly vertical crevices or fissures that are wider than the particle sizes of the injected solid material. After some time lapse, the injected fluid is hardened into a plate-like formation which is generally 3 to 4 cm and occasionally 30 cm in thickness and has a verticl extent in excess of 10 m.

It has now been discovered that, even if the soft viscous ground should extend to a depth of 10 m or so below the ground surface, the objective of consolidating the ground can sometimes be attained by having the ground reinforced to a depth of 2 to 3 m. In this case, further operation will represent loss of the fluid material. On the other hand, if the ground strength at the preselected injection sites were measured in advance of injection, the injection pressure of the fluid material can be adjusted properly on the basis of such measurement.

An object of the present invention is to provide an improved method and apparatus for improving the strength of the soft viscous ground, by means of which the aforementioned disadvantages can be obviated satisfactorily.

According to the research and development conducted by the present inventor, the injected cement mortar, cement milk or the like fluid will be forced into the soft or viscous ground when the injection pressure is larger than the local ground strength, because the soil yields under such higher injection pressure and fissures having a greater extent than the particle size of the injected solid material will be produced within the under ground zone. As the cement milk is injected continuously, a tree-like fluid wall structure will be produced in the underground formation. It will be noted that the ground has anomalously hard or soft regions and the injected fluid material will find its way through the least resistant portions of the clayey ground thus forming the tree-like wall structure. The branched wall structure of the still fluid cement milk or mortar will serve as transverse load acting on the ground formation portions of the soft ground surrounded on either sides by the branched portions of the wall structure are subjected to compaction and dehydration with progress of the injection. Consequently, the present method provides an accelerated compaction and dehydration of the soft grounds by dint of growth of the branched wall structure of the injected material. Moreover, the fluid wall undergoes gradual hardening until a rigid reinforcing structure is completed within the underground zone which has now become compact through dehydration.

In the construction method proposed in the aforementioned Japanese Patent Publication No. 23377/1973, sounding tests on soil quality are carried out at plural preselected points of the ground. The fluid material is usually injected from points intermediate between the points where the surrounding operation was previously performed. With this known method, there is no possibility for proper management of the injection because the ground strength at the desired depths of the actual injection points can not be grasped and thus the injection pressure can not be set in dependence upon the actual strength prevailing at the actual injection points. Summary of the Invention According to the present invention, measurement of an index for the ground strength and injection of the cement milk or mortar can be carried out consecutively by a self-contained measurement/injection device which is driven into the ground from the injection point. In the improved method proposed by the present invention, sounding or the like soil tests may be carried out as described above at several preselected points in the soft viscous ground.

However, according to the present invention, a measure or index of the ground strength at the injection point is then obtained by a self-contained measuring and injecting device. The initial injection pressure can then be set to a value above the index thus obtained for more facilitated reasonable injection of the fluid material.

In the inventive method, an index for the ground strength at the desired depth of a preselected injection point is measured first of all and the injection pressure is set to a value slightly larger than the index value.

Assuming that the ground strength itself is measured at the injection point in the aforementioned conventional method for setting the injection pressure to be larger than the measured ground strength, a complex and highly inaccurate conversion has to be carried out by using a specially prepared conversion diagram. Even if the injection pressure could be set to be higher than the local ground strength, the desired result can not be obtained because of conversion error and use of different devices for measurement and injection. According to the present invention, as an index for the local ground strength and the injection pressure can be indicated as reading on the same pressure gauge mounted on the ground surface. Thus, no error may be introduced in calculating the injection pressure. Such situation is highly favorable for the proper management of the continued injection of the fluid material.

List of Prior Publications

1. Japanese Patent Publication No. 23377/1973, invented by the present inventor and published on July 13, 1973, in the name of K. K. Oyo Chishitsu Kenkyusho, Tokyo, Japan.

2. Japanese Provisional Patent Publication No. invented by the present inventor and published on Dec. 1, 1977 in the name of the present inventor.

DESCRIPTION OF PREFERRED EMBODIMENTS

Figures 1, 2A, 2B, 2C:
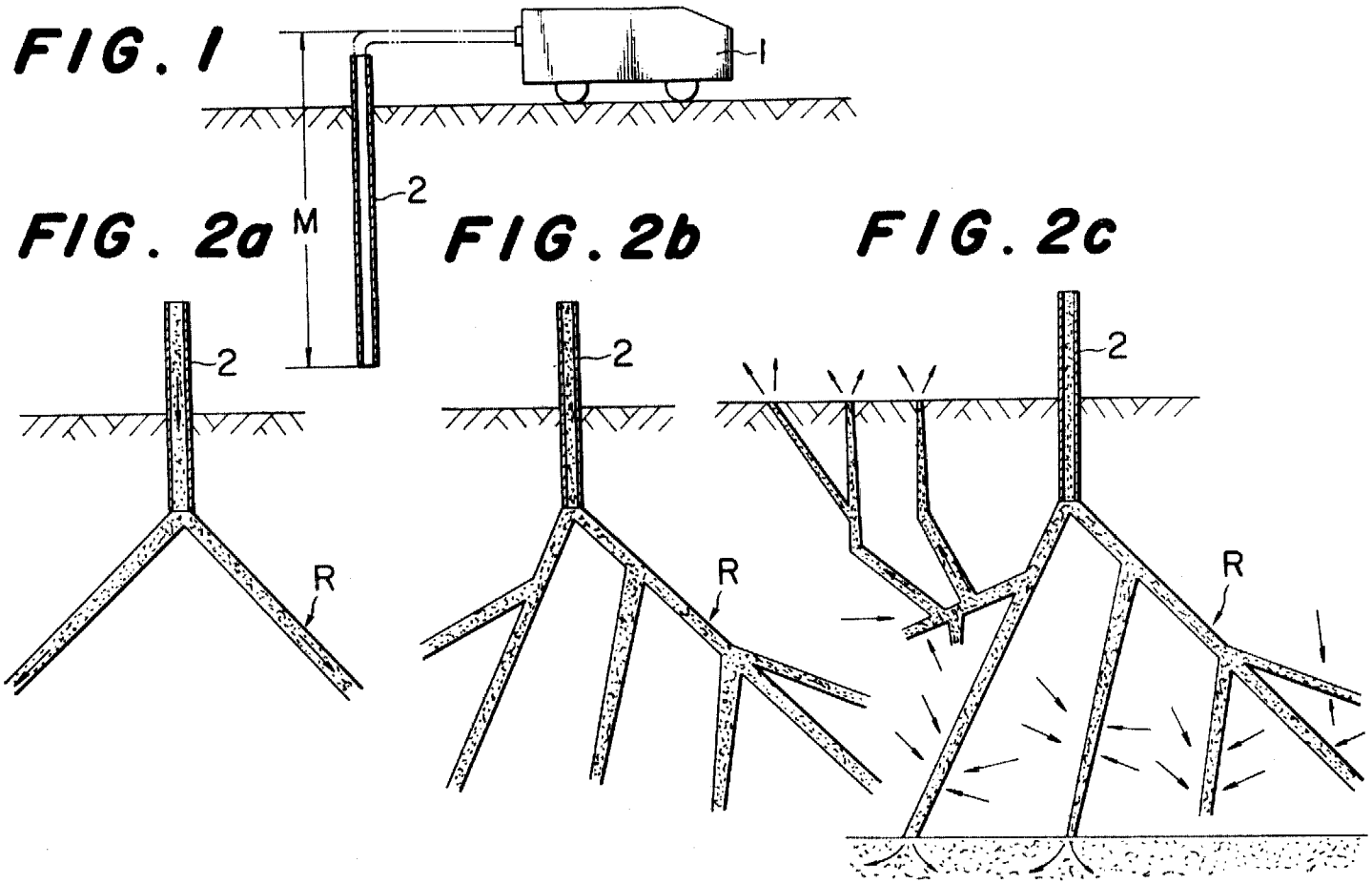
FIG. 1 is a diagrammatic view showing the basic principle of the inventive method.
FIGS. 2*a* to 2*c* are diagrammatic views showing the three stages in the working of the inventive method.

FIG. 1 shows diagrammatically the operating principle of the inventive construction method. The preferred injection material, hereafter referred to as fluid or fluid material, is the cement paste or milk to which fly ash obtained from blast furnace slugs or sawdust may be added for adjusting the density of the material, as will be described later. The material is injected by a pump 1 and a conduit 2 from a reservoir mounted on the ground surface. It will be seen that the injecting pressure P ($kg/cm^2$) may be expressed by the formula $$P=(A\times M)+D$$

where A is the density of the injected material in $kg/cm^2$, M the height of the liquid column in cm and D the discharge pressure of the pump, in $kg/cm^2$.

Supposing that the ground has the strength Q ($t/m^2$), the ground can be destructed to permit injection of the fluid material when $P>Q$. The balanced condition $P=Q$ is reached when the ground has been sufficiently strengthened and the injected material starts to be forced back towards the reservoir against the pumping pressure. When such state has been attained, the pumping operation can be safely discontinued, because such state is usually an indication that the ground has been consolidated satisfactorily. In FIG. 2*a*, the injection material has started to be pumped into the ground formation ($P>Q$). FIG. 2*b* shows the balanced condition $P=Q$ and FIG. 2*c* shows the condition $P<Q$. In FIGS. 2*a* to 2*c* R designates a branched wall structure formed upon hardening of the injected fluid material.

According to the inventor's finding, if the injection pressure for the fluid material is set at the outset to a value larger than the local ground strength, the relationship $P>Q$ can be maintained, and injection can be carried out consecutively. The reason may be such that one or more soft ground zones necessarily exist about the injection point and the injected material can find its way into these zones under the pumping pressure. The inventor is not fully aware of the complex mechanism involved in the compaction and dehydration of the soft ground portion caused by continued growth of the tree-like wall structure. However, the mechanism can be safely explained in the following manner. The pore water contained in the underground zone is discharged, with growth of the wall structure, into the near-by sand strata or to the ground surface. Thus the underground zone may be compacted with progress in the injection, resulting in the gradual increase in the ground strength. The still fluid wall plays the roll similar to that of the sand or paper drain and serves as water discharge passage. Moreover, during injection of the fluid material, there is produced vacuum in a portion of the fluid tree-like wall. The presence of vacuum may be ascertained by the fact that, when one places one's hand in the fluid material being conveyed to the supply pipe, with the injection discontinued, he will feel that he is pulled in the direction of the fluid flow. Pore water may be discharged into the fluid material by the operation of such vacuum. Pore water can also be discharged through a number of crevices connecting the fluid wall and the ground surface, as also ascertained by the experiments conducted at a number of construction sites.

Figure 3:
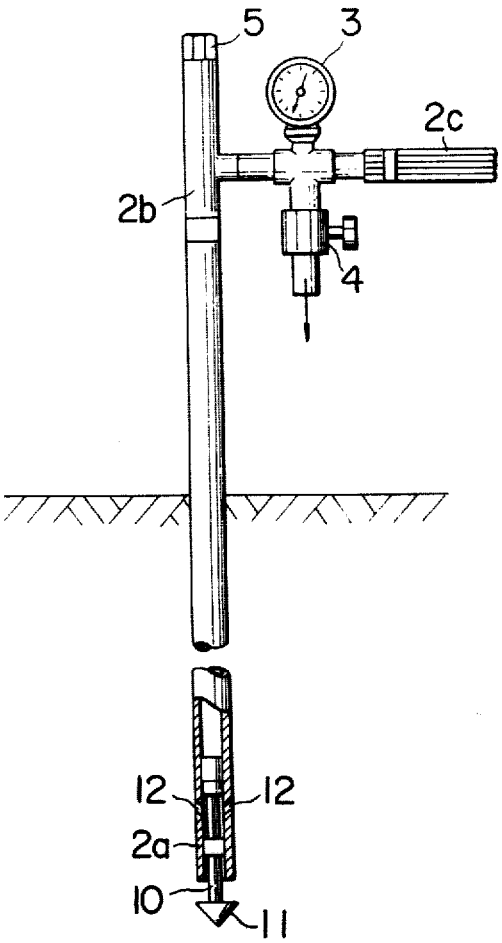
FIG. 3 is an elevational, shown in partial section, of the essential portion of the inventive apparatus.
Figure 4A:
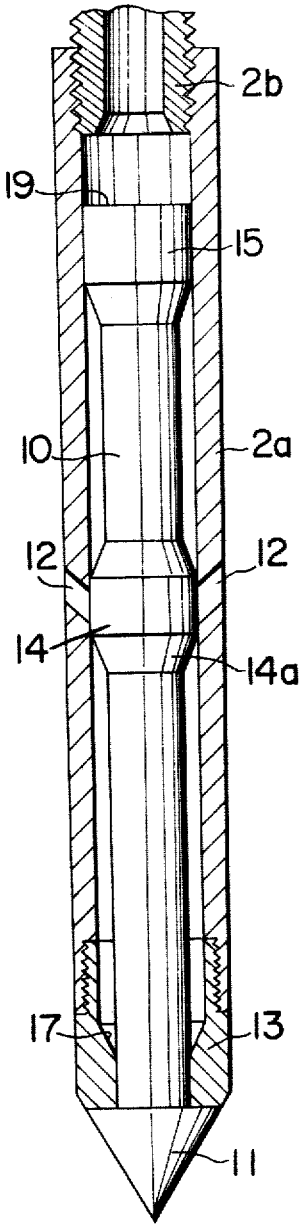
FIG. 4*a* is an elevational view shown in section, of an end portion of the apparatus of FIG. 3.

A preferred embodiment of the measuring/injection device of the present invention is illustrated in FIGS. 3, 4*a* to 4*c* and 8. Referring to FIG. 3, an injection pipe segment 2*a* is threadedly connected to one end of an extension pipe segment 2*b*, the other of which is connected to a supply pipe 2*c*. The numerals 3, 4 and 5 denote a pressure gauge, a sluice valve and a cap, respectively. The supply pipe 2*c* communicates with a cement mixer 8 through a grout pump 6 and a suction hose 7. In FIG. 4*a*, the injection pipe segment 2*a* is secured to the lower end of the extension pipe segment 2*b* and houses a piston rod 10 to the lower end of which is secured a cone 11. The piston rod 10 has an outside diameter slightly smaller than the inside diameter of the injection pipe segment 1 except for the central large diameter portion 14 and the upper large diameter portion 15. The wall portion of the pipe segment 2*a* is formed with a plurality of equally spaced apart through-holes or slits 12. In the embodiment of FIG. 4*a*, these slits 12 are formed obliquely upwards through the wall of the segment 2*a*. The slits 12 are so positioned that, as the piston rod 10 is lowered and an inclined surface 14*a* of the large diameter portion 14 rests on the corresponding inclined surface 17 of a stopper shoe 13 at the lower end of the pipe segment 2*a*, the lower inner eges of the slits 12 are aligned with or situated slightly above the upper surface 19 of the piston rod 10.

Figure 4B:
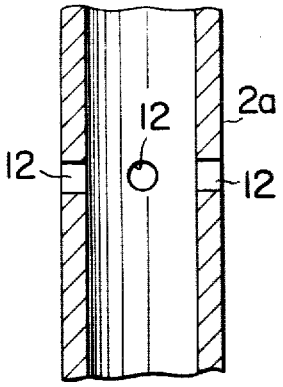
FIGS. 4*b* and 4*c* are partial elevational views, shown in sections, of the modified end portions of the apparatus of FIG. 3.
Figure 4C:
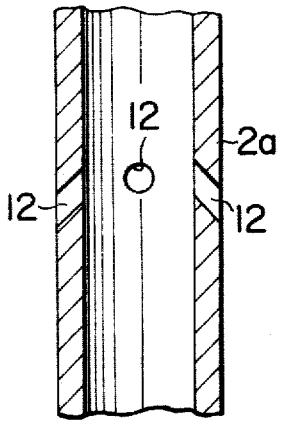

The slits 12 may be provided horizontally or directed obliquely downwards as shown in FIGS. 4*b* and 4*c* for controlling the injection area of the fluid material in accordance with the ground conditions, as will be described. The end cone 11 of the piston rod 10 is designed for measuring the local ground strength and has an end angle of 60°. The pipe sections 2*a*, 2*b* and the piston rod 10 mounted within the pipe section 2*a* are introduced to a desired depth at a given injection point. A pump 9 (see FIG. 8) is then driven to supply a fluid material such as the hardenable fluid material, but preferably water through the suction hose 7 and the supply pipe 2*c* for exerting a water pressure on the upper surface 19 of the piston rod 10, and driving the cone 11 into the ground. As the inclined surface 14*a* rests on the inclined surface 17 of the stopper shoe 13, the water is discharged through the exposed slits 12 into the surrounding ground zone. The change in the water pressure is indicated at this time on the pressure gauge 3. The mean value of the pressure change as indicated on the pressure gauge 3 during this time is a measure of the strength of the ground portion where the cone 11 is situated, that is, the ground portion into which the fluid material is about to be injected. The distance through which the cone 10 has traveled is equal to the distance between the inclined surface 17 and the slits 12 and may be 10 to 20 cm for practical purposes. During measurement of the index value, the pipe segments 2*a*, 2*b* serve for separating the piston rod 10 and the cone 11 from the near-by ground for avoiding the frictional contact between the piston rod 10 with the ground and precluding the measurement error.

After the measure of the local ground strength has been obtained, the water is discharged by opening the sluice valve 4, and the fluid material consisting e.g. of cement milk is supplied into the pipe segment 2*b* through the pipe segment 2*c*. With the discharge pressure of the grout pump 6 maintained to a constant value, an adjustment valve (not shown) provided at the supply pipe 2*c* or suction hose 7 is operated manually so that the aforementioned relationship $P>Q$ may be satisfied. The fluid material can then be injected consecutively from the slits 12 into the near-by zone. Alternatively, the hardenable fluid material may be used instead of water in measuring the ground strength.

The static pressure of the fluid material is equal to the mass of the liquid column extending from the pressure gauge 3 to the point of injection. As an alternative, the static pressure M can be adjusted instead of adjusting the discharge pressure of the adjustment valve. In this case, the height of the overall device including the pressure gauge must be changed for changing the injection pressure P. The composition or density of the injected fluid material can also be changed for adjusting the pressure P. In this case, the cement-water ratio can be modified, or alternatively, flyash or sawdust or similar aggregates can be added to the fluid material, so that the bulk density of the ground portion to be replaced by the liquid material can be matched to that of the fluid material.

Figure 3A:
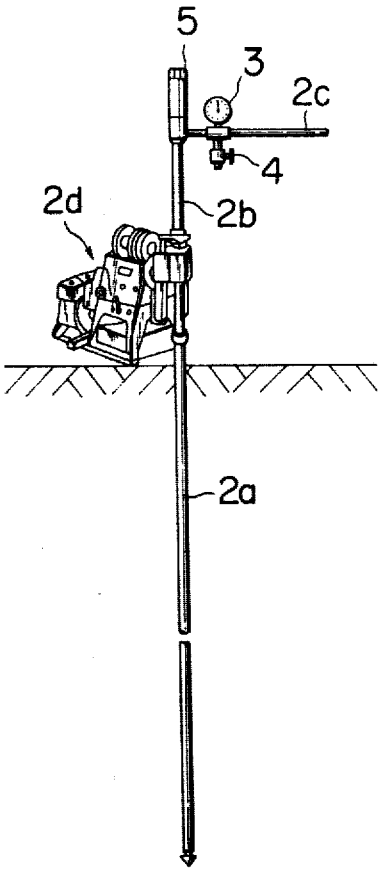
FIG. 3*a* is an elevational view similar to FIG. 3 and showing a modified embodiment of the apparatus.

As shown in FIG. 3*a*, a suitable rotational device 2*d* may be provided to the pipe segment 2*b* so that the sections 2*a*, 2*b* can be rotated about their axes during injection of the fluid material. In this way, the latter can then be injected non-directionally into the near-by ground portion.

Figure 5A:
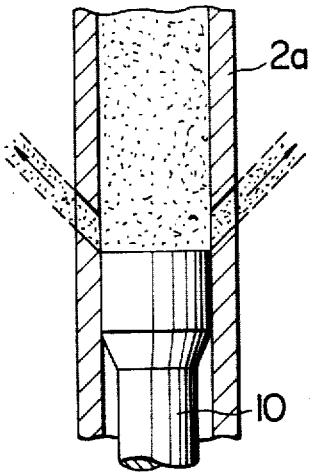
FIGS. 5*a* to 5*c* are diagrammatic views showing the operational aspects of the portions shown in FIGS. 4*a* to 4*c*, respectively.
Figure 5B:
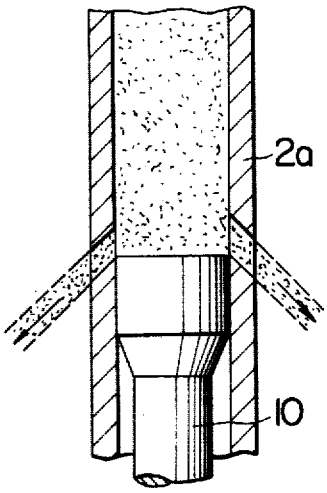
Figure 5C:
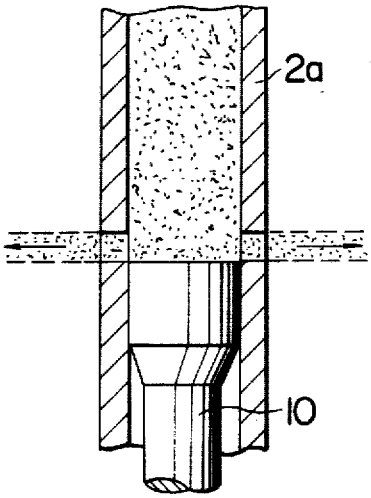
Figure 6A:
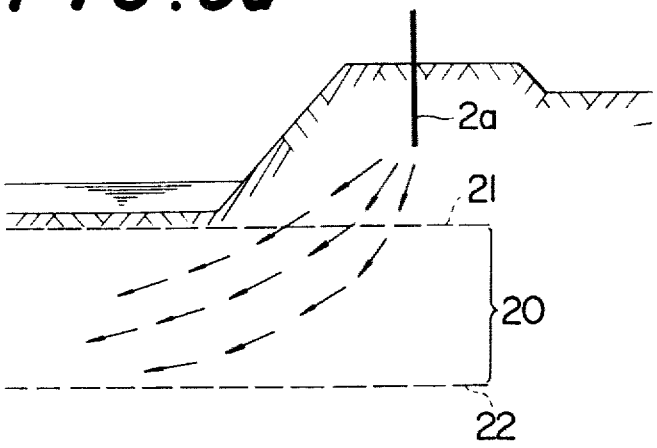
FIGS. 6*a* to 6*d* are diagrammatic views showing operational examples with the use of the inventive apparatus.
Figure 6B:
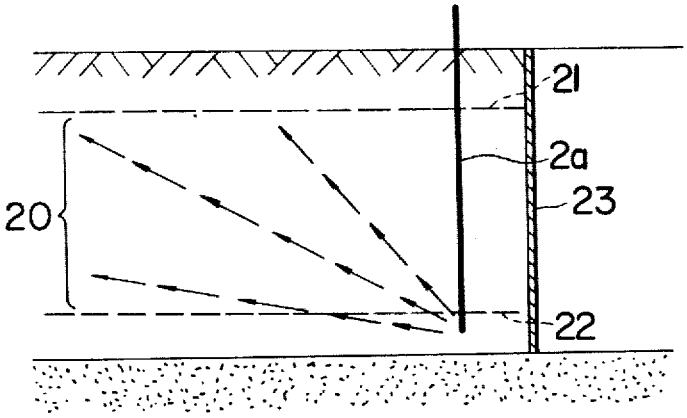
Figure 6C:
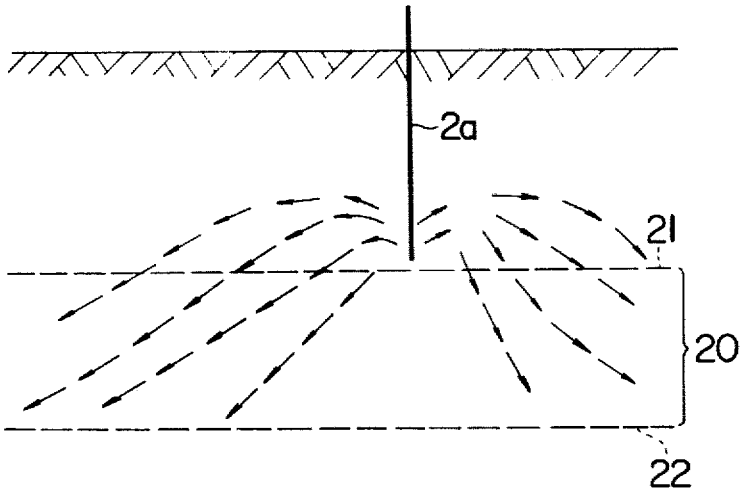
Figure 6D:
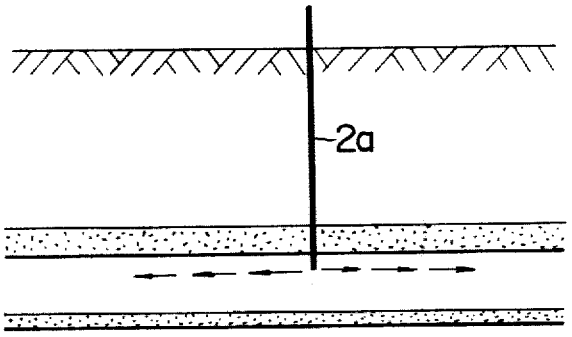

In FIG. 5*a*, the fluid material is injected obliquely upwards into the ground portion through upwardly inclined slits 12. In FIGS. 5*b* and 5*c*, the fluid material is injected obliquely downwards and in a horizontal direction, respectively. FIGS. 6*a* to 6*c* illustrate that the injection pipe segments 2*a* as shown in FIGS. 4*a* and 4*b* may be used for injection of the fluid material into the different ground portions. FIG. 6*a* illustrates as an example that the fluid material can be injected through the pipe segments 2*a*, 2*b* obliquely downwards for reinforcing the river bed from the river bank. In the drawing, the area 20 to be improved for ground strength is defined between an upper limit 21 and a lower limit 22. FIG. 6*b* illustrates that the injection pipe segment 2*a* can be used for injecting the fluid material obliquely upwards for improving the ground strength as far as a certain depth from the ground surface. If the area to be improved is confined to one side of an imaginary partition, a sheet pile 23 may be driven into the ground along such partition. FIG. 6*c* illustrates that a pipe segment 2*a* shown in FIG. 4*a* can be used on such occasion that the soft ground extends down to some depth but needs to be improved for only a portion of such depth. As the fluid material is directed obliquely upwards and then will flow downwards through an uppermost position, the static pressure ($A \times M$) of the liquid column will be zero when the material has reached said uppermost position. Injection of the fluid material occurs under the delivery pressure D developed by the pump, and the material can be distributed over the desired height range. FIG. 6*d* illustrates that the pipe segment 2*a* shown in FIG. 6*d* can be used for improving the strength of a soft ground portion that exists under the conditions shown in FIG. 6*d*.

Figure 7:
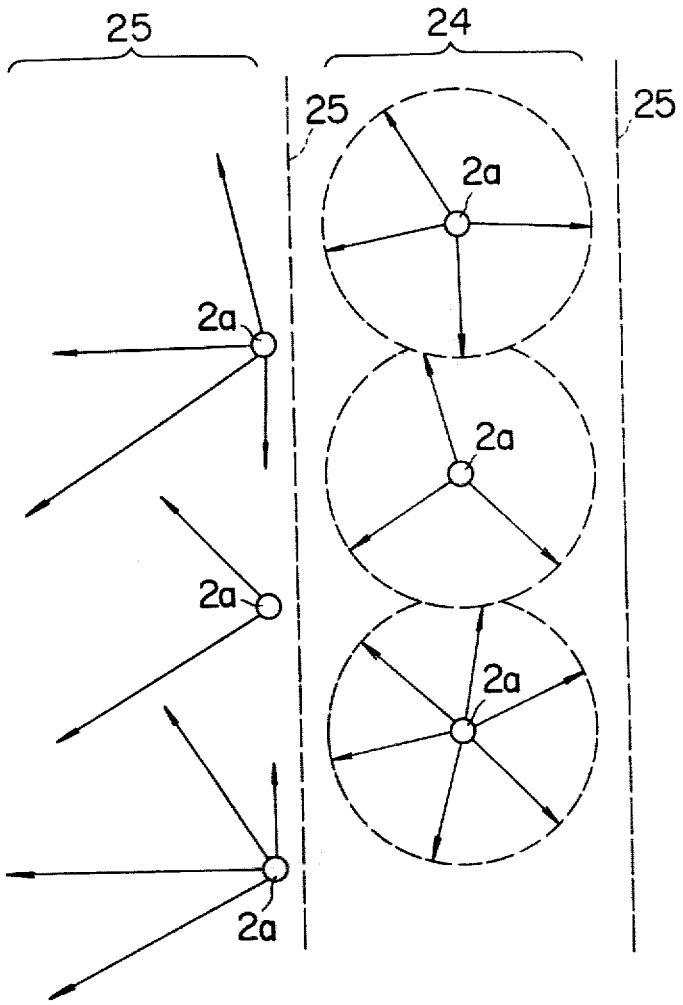
FIG. 7 is a top plan view showing a further operational example with the use of the inventive apparatus.

FIG. 7 illustrates that the fluid material can be injected for forming a peripheral wall 24 defining an area 25 to be improved and subsequently for strengthening the area 25 surrounded by the wall 24. For forming the wall 24, the pipe segment 2*a* is introduced successively at plural points, and the fluid material is injected through the slits 12 of the pipe segment 2*a* as indicated by the arrow marks. For injection into the soft area 25 surrounded by the wall 24, the pipe segment 2*a* and the pipe segment 2*b* attached thereto are introduced at plural preselected points, and the material is then injected from the slits 12 as indicated by the arrow marks. The wall 24 is usually formed on the four sides of the area 25. However, when the area 25 to be improved is the river bed, for example, each one wall 24 may be formed on both banks.

A sheet pile may be driven into the ground instead of forming the peripheral wall and removed after hardening of the fluid material.

A common Portland cement having a specific gravity mre than 3.05; 3-, 7- and 28- day bending strength values more than 12, 25 and 36 kg respectively and 3-, 7- and 28-day compression strength values more than 45, 90 and 200 kg respectively, and having such a property that it may start to be hardened in more than 1 hour may be completely hardened in less than 10 hours, is most preferred as cement of the fluid material. In a majority of cases, the cement-water mixture ratio may be 1:1 by weight. Depending on the mixture ratio, which depends in turn on the conditions of the area to be improved, flyash or sawdust or a similar additive may be added to the cement-water mixture for adjusting its density. In this case, the fluid material should have a density equal to that of the ground portion to be replaced by the fluid material.

Figure 9:
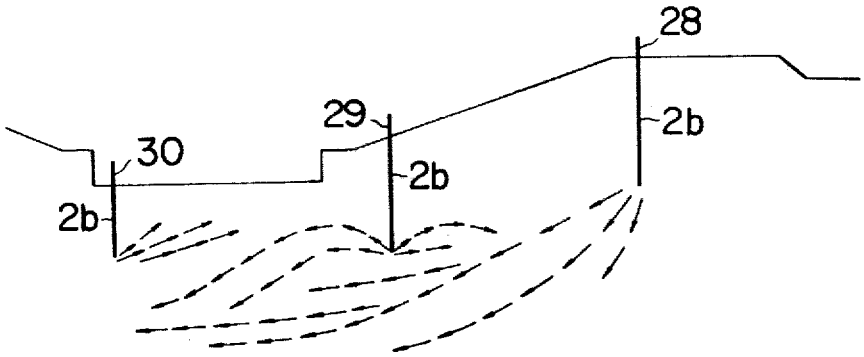
FIG. 9 is a diagrammatic view showing an operational example for the soft ground of the river bed with use of the inventive apparatus.

An example of an operation with use of the inventive method and apparatus will now be described by reference to FIG. 9, wherein the soft ground to be consolidated is the river bed. A slip plane extends from the bank to the river bed. The injection pipe segment 2*a* is driven into the ground at points 28, 29 and 30 for injecting the fluid material under the injection modes shown in FIGS. 6*c*, 6*a* and 6*b*, respectively. Although not shown in FIG. 9, plural points are provided along the river bed in three rows corresponding to the points 28, 29, 30. Injection of the fluid material is carried out at the point 28 or other points of the outer row for the first time. After completion of injection at the outer row, injection is carried out at the next row, and so forth.

The fluid material injected from the points 28 to 30 is gradually distributed towards the river bed and finally collects at a zone centered about the river bed for consolidating the ground zone between the bank and the river bed destroyed by slip. An approximate value of the ground strength for the area must be measured prior to the injection as conventionally for setting the target ground strength. In the operational example shown diagrammatically in FIG. 9, the ground strength was 0.7 t/m$^2$ before injection. In this case, target values for ground strength can be set to 0.7 to 0.8 t/m$^2$, 0.8 to 1 t/m$^2$ and 1.0 to 1.2 t/m$^2$ for the three rows including the points 28, 29 and 30, respectively. In the operational example, discussed above, it was confirmed experimentally that the target values for ground strength of 0.8 to 0.9 t/m$^2$ were actually realized near the slip plane after completion of injection at the outer row, and that the fluid material was distributed to close to the inner row inclusive of the point 29.

Figure 8:
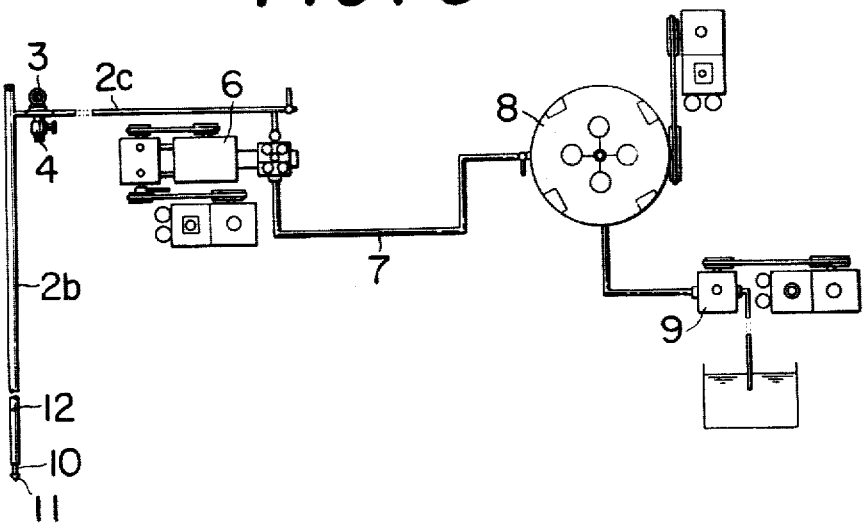
FIG. 8 is an overall view of a preferred embodiment of the inventive apparatus.

By way of an example of the invention, the process and result of an experiment which was conducted with use of the injection device illustrated in FIGS. 3 and 8 will be described below.

Example

A tube, about 4 m long, consisting of an injection pipe segment 2*a* (a sectional area, 10 cm$^2$; length, 30 cm; end cone angle, 60°) and an extension pipe segment 2*b* threaded thereto was driven to a depth of about 3.1 m at the point 29. The piston rod 2 was pressed by water supplied from the water pump 9 while the water pressure was read on a pressure gauge 3 mounted to the segment 2*b*. The piston rod 2 was driven in this way further for a distance of 30 cm, at which time the slits 4 were exposed to permit the discharge of water into the near-by ground zone. The pressure reading on the pressure meter 3 directly in advance of the abrupt decrease of the reading was 1.3 kg/cm$^2$.

The measure of the local ground strength thus obtained was used for calculating the cohesion C of the underground portion to which the cone advanced at this time.

The total pressure $P_T$ acting on the upper surface (sactional area, 6 cm$^2$) of the piston rod 10 may be calculated as follows.

$$P_T = 1.3\ \text{kg/cm}^2 \times 6 = 7.8\ \text{kg/cm}^2$$

As the end cone 11 has a sectional area of 10 cm$^2$, the cone supporting force qc is 0.78 kg/cm$^2$.

Thus, from a formula qc = 10.75 C for a viscous ground, the cohesion C may be calculated as follows.

$$C = 0.73\ \text{kg/cm}^2 = 0.73\ t/m^2$$

In a known manner, the cohesion C thus obtained represents the ground strength, and is substantially equal to the mean ground strength of 0.7 t/m$^2$ for the overall area which was obtained by the above-mentioned sounding test.

Injection of cement milk was then carried out in the following manner with the objective of improving the above value to target of 1.2 t/m$^2$.

40 pouches of a common portland cement (40 kgs per pouch) were charged into a cement mixer (capacity, 200 liters) and mixed with water at a mixture ratio of 1:0.94 by weight for preparing a cement milk.

The above mixture ratio was used for preparing a cement milk having a density equal to 1.5 t/m$^2$ which is the ground density of the area as measured in advance of injection. Thus, in this case, as cement density is 3.15 kg/lit. and water density 1 kg/lit., the added capacity of 4 cement pouches and water is 200.8 liters (cement capacity 50.8 liters; water capacity, 150 liters) and the added weight of the 4 cement pouches and water is 310 kg (cement weight, 160 kg; water weight, 150 kg). Thus, the mean density of the cement milk amounts to 1.54 t/m$^2$ which is approximately equal to the mean ground density, 1.5 t/m$^2$. Thus the cement milk density can be matched to the ground density at the time of injection.

An adjustment valve mounted in the supply pipe 2*c* was then operated for adjusting the delivery pressure of the grout pump 6 so that the pressure gauge 3 shows a reading of 1.2 kg/m$^2$. The cement milk was injected completely in about 2 hours. The pressure reading on the pressure gauge 3 was substantially constant and was approximately 1.2 kg/m$^2$ during the interval.

The ground strength as measured in 48 hours after completion of injection was 1 to 1.2 t/m$^2$ which is markedly higher than 0.7 t/m$^2$ as measured before injection.

The delivery pressure of the group pump was adjusted before injection of cement milk to the pressure gauge reading of 1.2 kg/m$^2$ by the following reason. As the water has been replaced by cement milk, with the pressure reading of 1.2 kg/cm$^2$ on the pressure gauge 3 mounted on the ground surface, the actual injection pressure should be 1.4 kg/cm$^2$, the difference of 0.2 kg/cm$^2$ being the static pressure difference between the water and cement milk at the depth of 3.5 m. Such injection pressure is obviously higher than the initial gauge reading of 1.3 kg/cm$^2$ and should be sufficient to destroy the nearby ground. In the present operational example, as more and more cement milk was injected into the ground and permeated into the nearby zone, there were always some soft zones on the boundary between the cement milk and the ground which could be destroyed by the cement milk. The latter could thus be injected consecutively at substantially the constant injection pressure. However, if the surrounding ground should be saturated with the injected material, the latter tends to flow back against the discharge pressure of the grout pump, resulting in the increased reading on the pressure gauge 3. Such condition would indicate that the surrounding ground has been consolidated satisfactorily and there is no necessity for further injection.

According to the present invention, the soft viscous ground can be reinforced in a much shorter time than that heretofore required with the paper or sand drain method or sand loading method. Moreover, the present method can be applied to an area where application of the conventional method was not possible because of the topographical factors. The injected cement milk acts as a transverse load acting on the soft viscous ground to promote dehydration and compaction. The solidified material will form a rigid tree-like wall which serves as skelton for the ground. The present method can be worked with a system in which the pump and cement mixer are mounted fixedly in predetermined points in the area being consolidated and the suction hose is transferred, together with the supply pipe, to each of a plurality of injection points. The injection pipe segments with the slits of different orientations may be used depending on the particular ground property.

During operation, the measure of the local ground strength may be read on a pressure gauge, and the static pressure or the pump discharge pressure may then be adjusted so that the initial injection pressure reading on the pressure gauge will be higher than the measure of the local ground strength. The cement milk may then be injected at substantially the same pressure until the near-by ground is consolidated to the degree that no further strengthening would be required. Thus, the operation on the site can be managed more properly than would be the case if the injection were carried out without previous knowledge of the ground strength at the site of actual injection.

What is claimed is:

1. A method for improving the strength of the soft viscous ground by injection from the ground surface of a hardenable fluid material comprising essentially a cement milk or cement/water mixture, said method comprising the steps of:

(a) introducing into the ground to a required depth an assembly comprising a tubular method adapted for supplying the hardenable fluid material into the ground, injection holes for the hardenable fluid material formed in the wall portions of said tubular member and a piston rod slidably disposed within said tubular member;

(b) supplying a fluid material under pressure into said tubular member from the top thereof;

(c) obtaining a measure of the ground strength as a delivery pressure of the fluid material that prevails when the piston rod has descended to a position such that the fluid material contained in the tubular member can flow outwardly from the injection holes formed in said tubular member;

(d) adjusting the injection pressure of the hardenable fluid material based upon said measure of the ground strength;

(e) injecting the hardenable fluid material from points where the above measure was obtained into the ambient zones of the ground for distributing the hardenable fluid material into the surrounding underground portion; and (f) consecutively injecting the hardenable fluid material in this manner starting from each of said points so that the zone of fluid dispersion from a given one of said points will be at least continuous to the adjacent zone of the fluid dispersion neighboring thereto.

2. The method as defined in claim 1 further comprising the hardenable injection presure of the fluid material being adjusted in dependence upon any combination of the delivery pressure of the material into the tubular member, static pressure and the hardenable gravity of the fluid material.

3. The method as defined in claim 2 further comprising adjusting the harenable specific gravity of the fluid material to substantially equal the specific gravity of the ground.

4. An apparatus for improving the strength of the soft viscous ground by injection into the ground of a hardenable fluid material, said apparatus comprising:

(a) a tubular member for applying the hardenable fluid material into the ground;

(b) injection holes for the hardenable fluid material formed in the wall of said tubular member;

(c) a piston rod slidably disposed within said tubular member;

(d) means for supplying the hardenable fluid material under pressure into said tubular member;

(e) means for obtaining a measure of the local ground strength based on the decrease in the delivery pressure of a fluid material that prevails when the piston rod has lowered, in the course of descent into the ground under the pressure of the fluid material supplied from the top into the inside of said tubular member, to a position such that the fluid material can flow outwardly from the injection holes into the nearby underground portions; and (f) said means for supplying the hardenable fluid includes means for adjusting the pressure of said hardenable fluid in accordance with said measure of the local ground strength.

5. Apparatus for improving the strength of earth by injecting a hardenable fluid thereinto comprising:

(a) tube means for insertion to a selectable depth into the earth;

(b) a cylinder at the end of said tube means;

(b) a piston displaceably disposed in said cylinder;

(d) a piston rod connected to said piston;

(e) a pointed end on said piston rod, said pointed end being axially displaceable a predetermined distance through the end of said cylinder into the earth;

(f) at least one opening in said cylinder intermediate the ends thereof;

(g) means for admitting fluid pressure through said tube meas into said cylinder;

(h) said piston rod being forceable through the end of said cylinder against the resistance of the earth;

(i) means for measuring the fluid pressure required to displace said piston rod said predetermined distance;

(j) said piston sealing said at least one opening from said fluid pressre until said piston rod is displaced outward said predetermined distance and thereafter opening said at least one opening whereby said hardenable fluid is injected into the earth; and (k) means for supplying said hardenable fluid at a pressure related to said fluid pressure.

6. Apparatus recited in claim 5 further comprising:

(a) means for mixing a watery mixture of hardenable fluid; and (b) pump means for pumping said watery mixture to said means for admitting.

7. A method for improving the strength of the soft viscous ground by injection of a hardenable fluid material from the ground surface using an injector assembly having a tubular member adapted for supplying the hardenable fluid material into the ground, injection holes for the fluid material formed in the wall portions of said tubular member and a piston rod slidably disposed within said tubular member, said piston rod sealing said injection holes until moved a predetermined distance by fluid pressure thereon, comprising the steps of:

(a) introducing said injector assembly into the ground to a required depth;

(b) supplying a fluid under pressure into said tubular member from the top thereof;

(c) measuring the ground strength as a delivery pressure of the fluid that prevails when the piston rod has descended said predetermined distance such that the fluid contained in the tubular member can flow outwardly from the injection holes formed in said tubular member;

(d) adjusting the injection pressure of the fluid based upon said measure of the ground strength;

(e) injecting the hardenable fluid material at said injection pressure from the points where the above measure was obtained into the ambient zones of the ground for distributing the hardenable fluid material into the surrounding underground portion; and (f) consecutively injecting the hardenable fluid material in this manner in adjacent zones starting from each of said points so that the zone of hardenable fluid dispersion from a given one of said points is at least contiguous to the adjacent zone of hardenable fluid dispersion.

8. The method defined in claim 7, wherein the step of adjusting said injection pressure includes adjusting said injection pressure in dependence upon any combination of a delivery pressure of the material into said tubular member, a static pressure and a specific gravity of said hardenable fluid material.

9. The method as defined in claim 8, further comprising adjusting said specific gravity of said hardenable fluid material to substantially equal a specific gravity of the ground.

10. An apparatus for improving the strength of the soft viscosity ground by injection of a hardenable fluid material from the ground surface, comprising a tubular member having wall portions adapted for supplying said hardenable fluid material into the ground, injection holes for said hardenable fluid material formed in said wall portions of said tubular member and a piston rod slidably disposed within said tubular member, said piston rod sealing said injection holes until moved a predetermined distance by fluid pressure thereon, means for obtaining a measure of the local ground strength based on the decrease in the delivery pressure of a fluid material that prevails when said piston rod has moved said predetermined distance into the course of descent into the ground under the pressure of said fluid material supplied from ground surface to the inside of said tubular member, to a position such that the fluid material can flow outwardly from the junction holes into the nearly underground portions, and means for supplying said hardenable fluid material to said tubular member at a delivery pressure related to said measure of the local ground strength.

11. The apparatus recited in claim 10, in which said injection holes are provided by a plurality of equally spaced apart through-holes or slits.

12. The apparatus recited in claim 11, in which said through-holes or slits are directed obliquely upwards, horizontally or obliquely downwards for controlling the injection area of the ground condition.

* * * * *